United States Patent [19]

Andrews, Jr. et al.

[11] 4,392,705

[45] Jul. 12, 1983

[54] ZERO INSERTION FORCE CONNECTOR SYSTEM

[75] Inventors: Howard W. Andrews, Jr., Hershey; Timothy B. Billman, Carlisle; Robert F. Cobaugh, Elizabethtown, all of Pa.

[73] Assignee: AMP Incorporated, Harrisburg, Pa.

[21] Appl. No.: 300,333

[22] Filed: Sep. 8, 1981

[51] Int. Cl.[3] ..... H01R 13/029

[52] U.S. Cl. ..... 339/75 MP; 339/17 LC

[58] Field of Search ..... 339/74 R, 75 M, 75 MP, 339/17 L, 17 LC

[56] References Cited

U.S. PATENT DOCUMENTS

| | | | |
|---|---|---|---|
| 3,315,212 | 4/1967 | Peterson | 339/75 M |
| 3,848,222 | 11/1974 | Lightner | 339/75 M |
| 4,047,782 | 9/1977 | Yeager | 339/75 MP |
| 4,077,688 | 3/1978 | Cobaugh et al. | 339/74 R |
| 4,220,389 | 9/1980 | Schell | 339/75 MP X |
| 4,261,631 | 4/1981 | Guilcher et al. | 339/75 MP |
| 4,314,736 | 2/1982 | Demnianiuk | 339/75 MP X |

*Primary Examiner*—Eugene F. Desmond

*Attorney, Agent, or Firm*—Allan B. Osborne

[57] ABSTRACT

The present invention relates to a connector system for electrically connecting a circuit card to a circuit board. More particularly the connector system includes an upper card-carrying member mated into a lower board mounted member without requiring insertion forces. Cam means on the lower member move the upper member laterally to electrically engage the contact elements positioned in both members.

2 Claims, 12 Drawing Figures

ZERO INSERTION FORCE CONNECTOR SYSTEM

U.S. Pat. No. 4,077,688 discloses a card edge connector having camming means which deflect contact elements out of a card edge-receiving slot so that the card may be freely inserted therein.

U.S. Pat. No. 3,848,222 discloses a connector system having male and female connectors which require very small forces for mating. One of the connectors is provided with a camming means which acts on the other connector to effect a relative transverse motion therebetween to bring the enclosed contacts into mating engagement. Each contact of one connector has a form of a resilient leaf while the other has a form of a fixed and relatively rigid pin. The male and female connectors are mated in a conventional manner but no engagement of the contacts occurs until after the connectors have been moved transversely with respect to one another by the camming means.

The present invention is intended to provide a connector system adapted to receive and retain a circuit card on one member which is mated with a second member, both members having surface-to-surface contacting elements, without the use of force. Cam means on the second member moves the first member transversely so that engagement between the contacting elements can occur.

More particularly, the connector system is, according to the present invention therefore, characterized in having a lower member carrying a plurality of conductive contact elements also arranged in a longitudinal line with contact surfaces thereon extending below the under surface, and further contact means on the elements extending above the top surface for being attached to a circuit card mounted on edge on the top surface of the upper member, and camming means on the lower member so that upon placing the upper member on the lower member, the upper member can be moved laterally whereupon the contact surfaces on the contact elements in both members will be electrically connected.

For a better understanding of the invention, reference will now be made by way of example to the accompanying drawings, in which.

Figure 1:
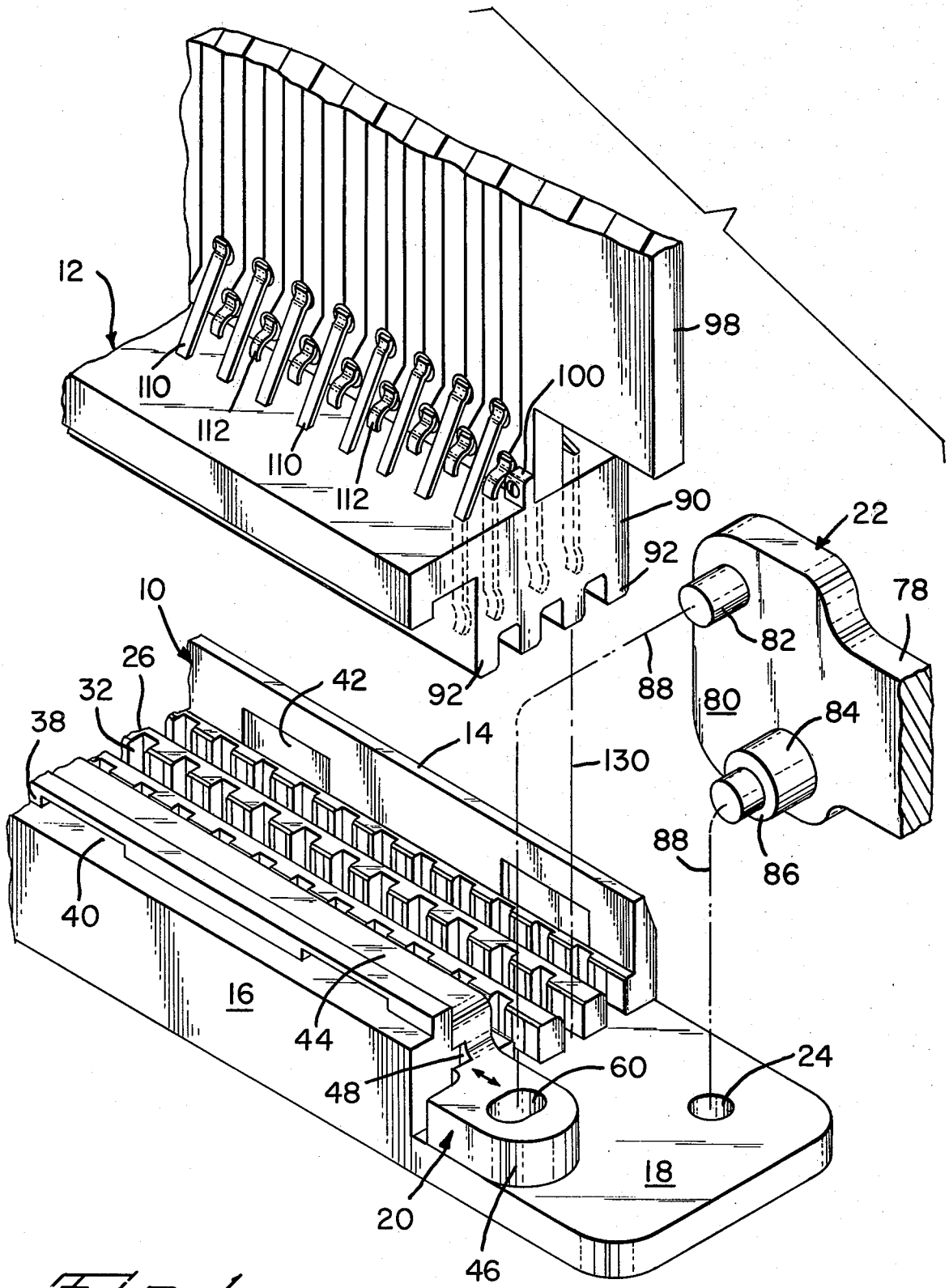
FIG. 1 is a perspective view of the two member card edge connector system which embodies the present invention.

As shown in exploded fashion in FIG. 1, the two members of the connector system of the present invention includes lower member 10 and upper member 12.

The insulative components of both members are preferably molded, using a plastic such as glass filled NYLON. The conductive components of both members are preferably stamped and formed from coplanar stock such as phosphor bronze.

With regard to lower member 10, the generally U-shaped structure includes side walls 14 and 16 joined by floor 18. The floor extends forwardly of the sidewalls to provide a surface for actuating cam means 20 with lever 22. Opening 24, located in the floor, cooperates with the lever in that function.

Figure 2:
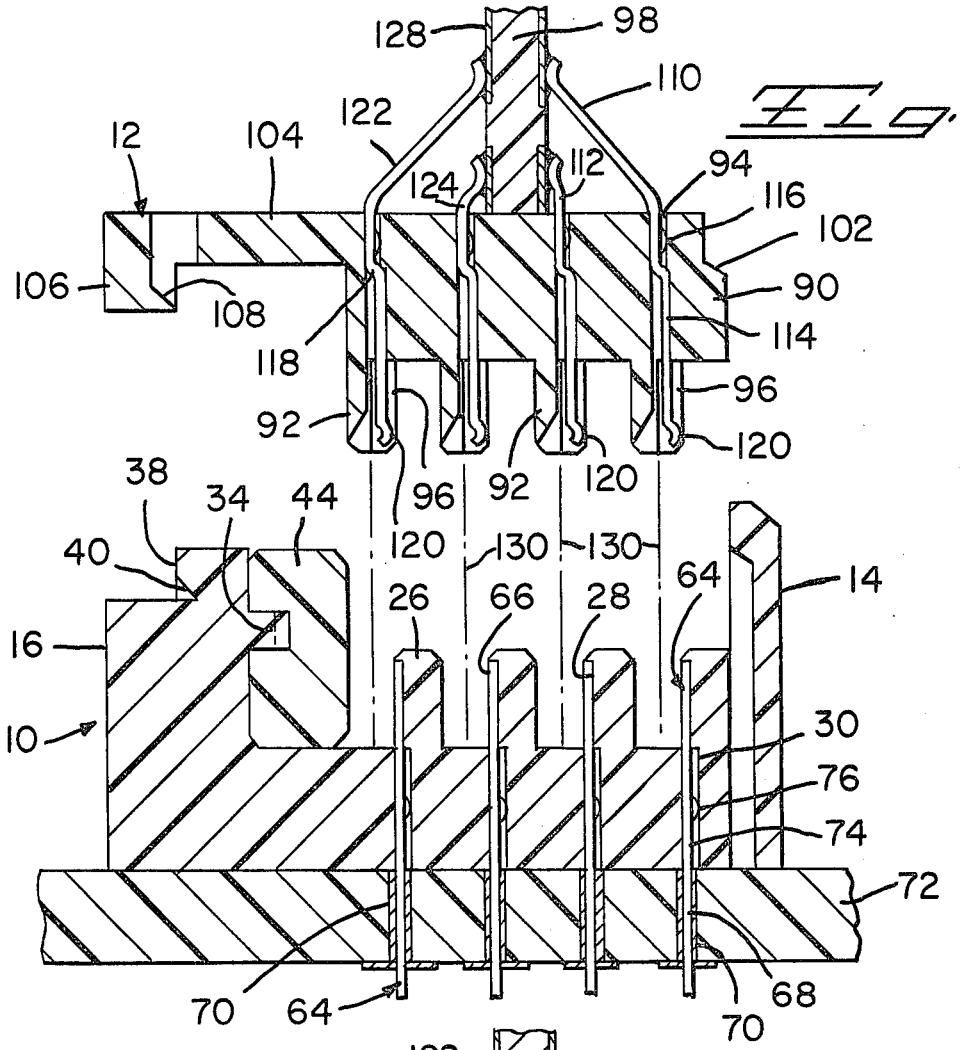
FIG. 2 is a cross-sectional view of the two members of FIG. 1.

Further included are four parallel ribs 26 of short stature relative to the aforementioned sidewalls. One such rib is attached to sidewall 14 and the other three are evenly spaced across floor 18 as shown in FIG. 2. Each rib has a number of spaced, shallow channels 28 which are continuations of passages 30 which extend vertically through floor 18. Recesses 32 are provided between each channel as shown in FIG. 1.

Figure 5:
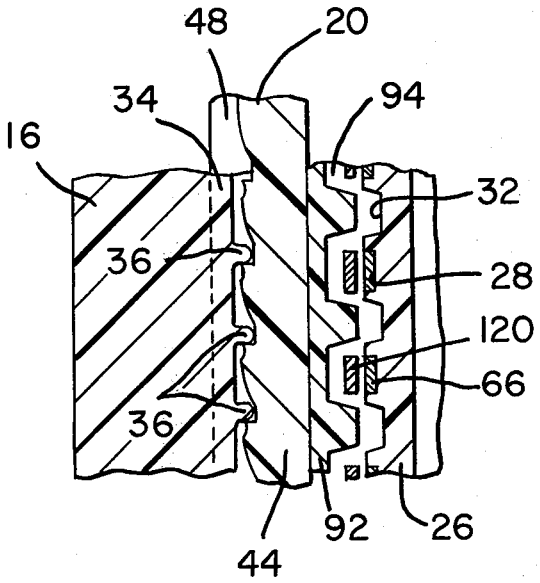
FIGS. 5 and 6 are cross-sectional views illustrating the camming action.
Figure 6:
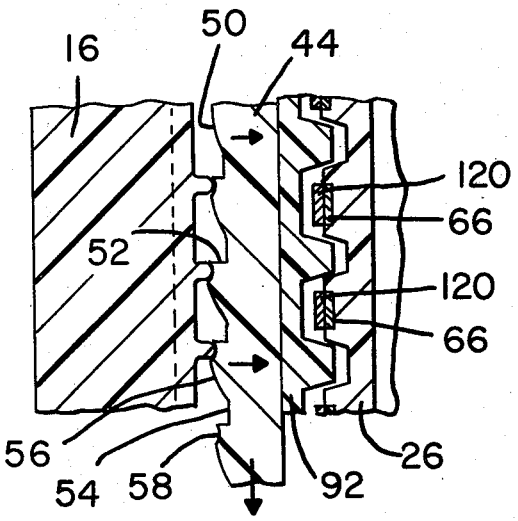

As shown in FIG. 2, rail 34 is attached to and runs down the length of the inside surface of sidewall 16. A number of round protuberances or bosses 36 are located along the length of the rail and face towards opposing sidewall 14. FIGS. 5 and 6 show these bosses. The rail forms part of cam means 20.

The top surface of sidewall 16 has two levels to provide a lateral face 38 into which two or more spaced-apart openings 40 are provided. FIGS. 1 and 2 show this structure. Similarly, two or more spaced apart openings 42 are provided in the inside surface of sidewall 14 just above the attached rib 26.

With reference first to FIG. 1, cam means 20 further includes an elongated bar 44 and a lever attaching piece 46 which is on the front end of the bar. A rail-receiving groove 48 is provided in one side of bar 44. With reference now to FIGS. 5 and 6, the floor of groove 48 consists of several repeating ramps 50 and steps 52. From the base of each step, the ramps are flat for a short distance as indicated by reference numeral 54. They then slope up (relatively) towards the top of the next step with the slope 56 describing a convex surface. Adjacent the next step, a dip 58 is provided in the ramp.

With reference to FIG. 1 again, attaching piece 46 of cam means 20 has a kidney shaped opening 60 therein.

Lower member 10 carries a number of first contact elements 64. These can be seen in profile in FIGS. 2, 3, and 4. Essentially each element 64 is elongated with a substantial width. The upper end provides a contact surface 66 which is received in channel 28 in ribs 26. The lower end 68 is adapted to pass through holes 70 in circuit board 72 wherein they are soldered or otherwise retained. The intermediate section 74 is received in passage 30 of lower member 10 and has an embossment 76 thereon to retain the element therein.

Lever 22, shown partially in FIG. 1, is simply a long handle 78 with one enlarged end 80. Two pegs are mounted on end 80, one peg 82 being located diagonally from second peg 84. Peg 84 has two concentric sections of unequal diameters to provide a shoulder 86 facing away from the lever. The lever can be made from any suitable, rigid material.

Cam means 20 is moved longitudinally with lever 22 in the following manner. The lever is placed on the part of floor 18 extending forwardly of sidewalls 14–16 with peg 82 being received in opening 60 and peg 84 being received in opening 24 with shoulder 86 resting on the floor surface. The shoulder places the lever even with the top surface of piece 46. Dashed lines 88 show this assembly. By rotating the lever about peg 84, peg 82 moves in an arc therearound and, being in opening 60, pulls or pushes cam means 20 with it. By moving the lever counterclockwise, cam means 20 moves longitudinally forward. With lever 22 being moved clockwise, cam means 20 moves longitudinally backwards. As the cam means move longitudinally bosses 36 on rail 34 and ramps 50 cooperate to move the cam means laterally in a well known fashion. FIG. 5 shows bar 44 of cam means 28 close to sidewall 16 and steps 52 abutting bosses 36 preventing further rearward motion. FIG. 6 shows the bar moved laterally away from sidewall 16 by cooperating action between the bosses and ramps. As the bosses (relatively speaking) move into dips 58, the bar will move back towards sidewall 16 slightly. This motion provides a wiping action as will be pointed out further on.

Referring again to FIG. 1, upper member 12 is an elongated, basically rectangular body 90 with four ribs 92 forming the underside. These ribs are spaced laterally from one another on the same spacing as ribs 26, in between which ribs 92 fit. With reference to FIG. 2, passages 94 are provided through body 90 and ribs 92 with the passages being open on one side of the ribs. These lateral openings are indicated by reference numeral 96. As shown in FIG. 1, there are four longitudinal lines of passages with four passages extending transversely across body 90 forming a row. Clearly, each line is in alignment with a rib 92.

Each row is bisected by placement of a circuit card 98 so that two passages of each row are on one side of the card and the other two are on the opposite side.

Ears, flanges, or other similar structural devices are provided on body 90 to removably retain the card thereon. One such device is indicated by reference numeral 100 in FIG. 1.

As seen in FIG. 2, two or more projections 102 are located along one side of body 90. A thin extension 104, located on the opposite side of the body, provides support for a depending arm 106. Two or more spaced bevelled fingers 108, attached to the arm, point inwardly to the body.

Upper member 12 carries a number of second contact elements 110 and third contact elements 112. With reference to both FIGS. 1 and 2, both elements 110 and 112 have an intermediate section 114 on which is an embossment 116. This section is received in passage 94 with the embossment acting to retain it therein along with a jog 118 in the section just below the embossment. The lower end of elements 110 and 112 are also identical, each having a convex contact surface 120. This surface faces out through lateral opening 96 in rib 92.

The upper ends of elements 110 is an elongated section 122 extending in an oblique direction relative to the rest of the element. The direction taken depends on which side of card 98 the element is to be located.

The upper ends of elements 112 are very short and curve slightly as indicated by reference numeral 124. As with elements 110 the upper ends curve either left or right depending on which side of the card the element is to be located.

Convex contact surfaces 126 are provided at the free ends of the upper ends of both elements 110 and 112. With the contact elements positioned in passages 94, these contact surfaces 126 bear against conductive traces 128 on card 98.

FIGS. 1 and 2 shows the two members 10 and 12 spaced apart with dashed lines 130 indicating the line of assembly; i.e., the upper member may be dropped into the lower member with ribs 92 of the former being received in the spaces between ribs 26 of the latter. As clearly shown in FIG. 2, ribs 92 will be to the reader's left of ribs 26 so that lateral openings 96 are in alignment with contact surfaces 66 in channels 28 in those ribs. Further, the rib 92 adjacent the left side of body 90 will be received in the space bounded along one side by bar 44 on cam means 20. In each case the ribs on one member will be in very close proximity to a rib on the other member and to bar 44 in the case of the left-hand rib 92.

Although not shown, it is apparent from the drawings that the two members can be mated by longitudinally sliding one into the other.

Figure 3:
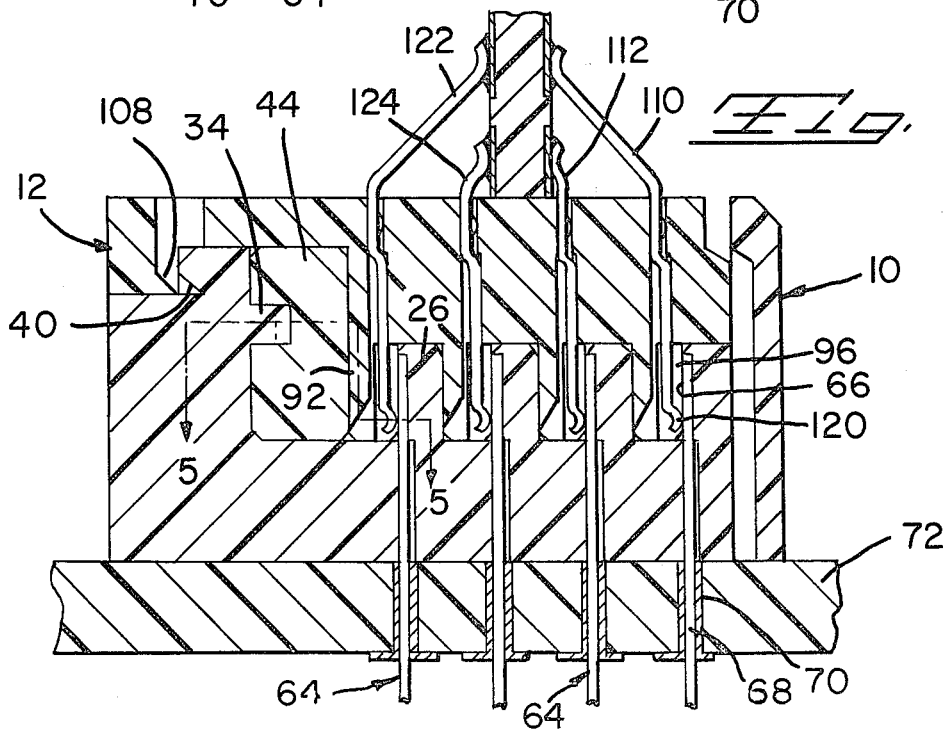
FIGS. 3 and 4 are end cross-sectional views showing the two members in a mated open and closed position respectively.

FIG. 3 shows the two members mated but in an open position; i.e., the contact elements in both members are not in electrical contact. FIG. 5 shows the position of cam means 20, bosses 36 and contact surfaces 66, 120 on contact elements 64 and 110.

Figure 4:
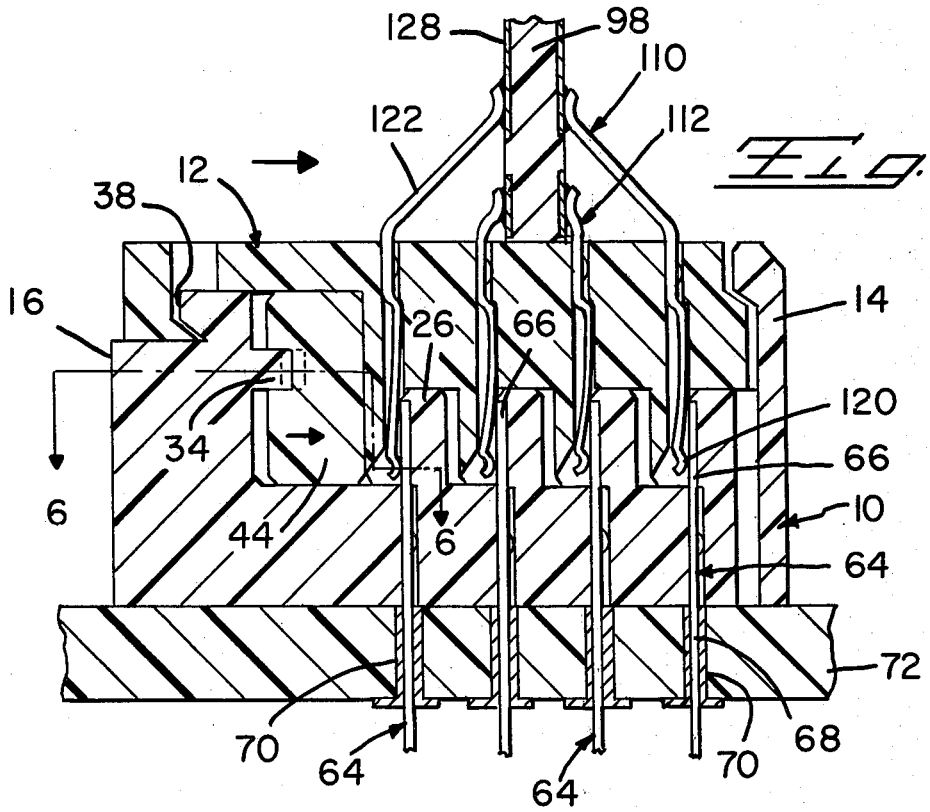

FIGS. 4 and 6 shows the two mated members 10 and 12 in a closed position; i.e., the contact elements in both members are in electrical engagement with each other. By moving cam means 20 longitudinally as noted above, bosses 36 and ramps 50 cooperate to drive bar 44 laterally. Upper member 12 moves towards sidewall 14 on the lower member under the force of the bar so that contact surfaces 120 on the lower ends of contact elements 110–112 are forced against contact surfaces 66 on contact elements 64. As the bosses move into dips 58, cam means 20 and the upper member move laterally back towards sidewall 16 under the compressed force of contact elements 110–112. The contact surfaces on all the elements shift vertically slightly so as to rub against each other. This wiping action cleans the contact surfaces to enhance the electrical contact.

FIGS. 7 through 12 illustrate a second embodiment of the present invention. The materials preferably used are the same as for the above described system.

Figure 7:
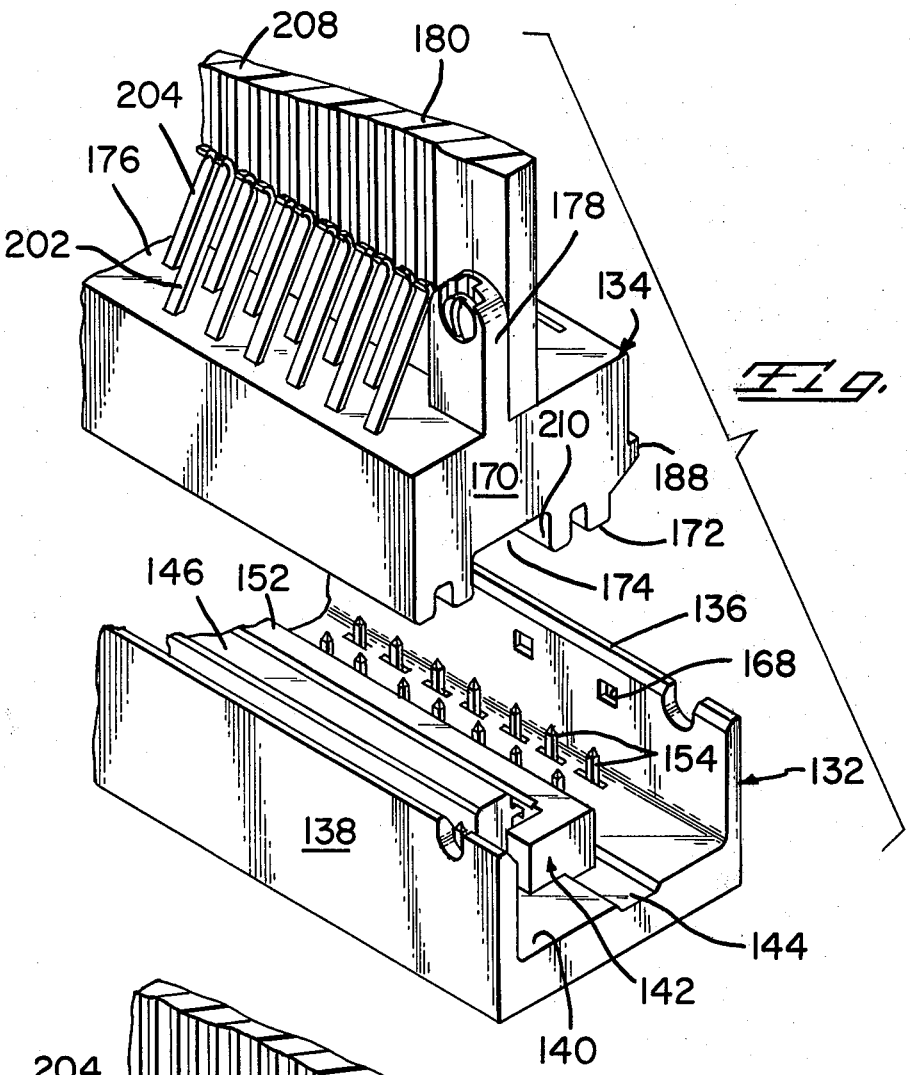
FIG. 7 is a perspective view of another embodiment of a two member card edge connector system which embodies the present invention.
Figure 8:
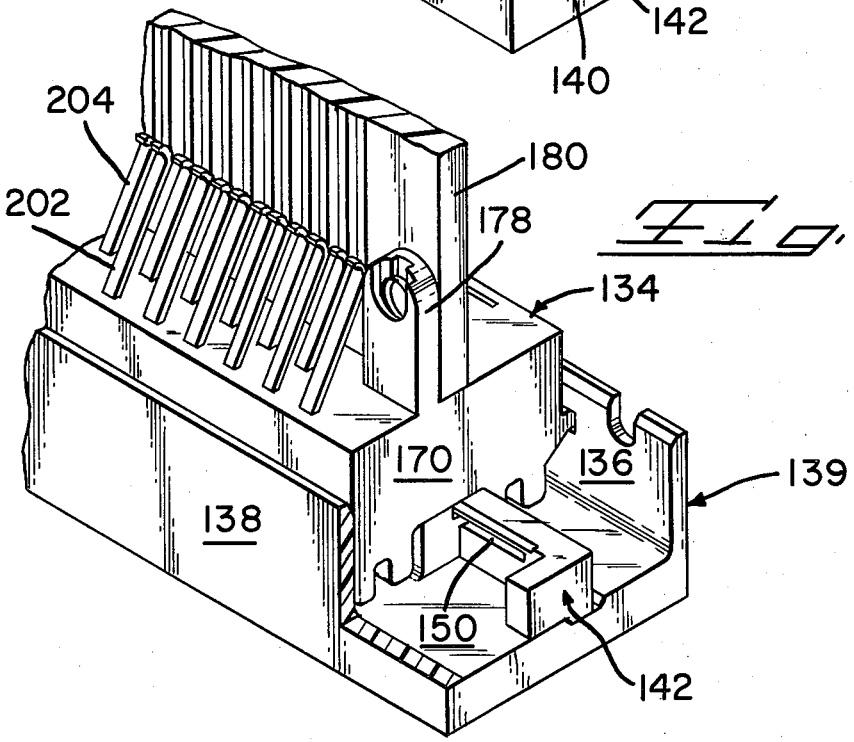
FIG. 8 is a perspective view of the connector system of FIG. 7 with the two members shown mated.

With reference to FIGS. 7 and 8, the connector system includes two members, lower member 132 and upper member 134.

Lower member 132 is U-shaped with sidewalls 136 and 138 being joined by floor 140. Cam means 142 includes bar 152 which slides longitudinally in groove 144 in floor 140 with the groove being between the two sidewalls. A support wall 146 which is part of cam means 142 parallels the groove and carries on one side a rail 148 (FIG. 9) which is received in groove 150 located in one side of bar 152. The rail has a number of bosses (not shown) spaced therealong to cooperate with the series of ramps and steps (not shown) forming the floor of groove 150 of bar 152. The bosses, ramps and steps function in the same manner as those previously described.

Figure 9:
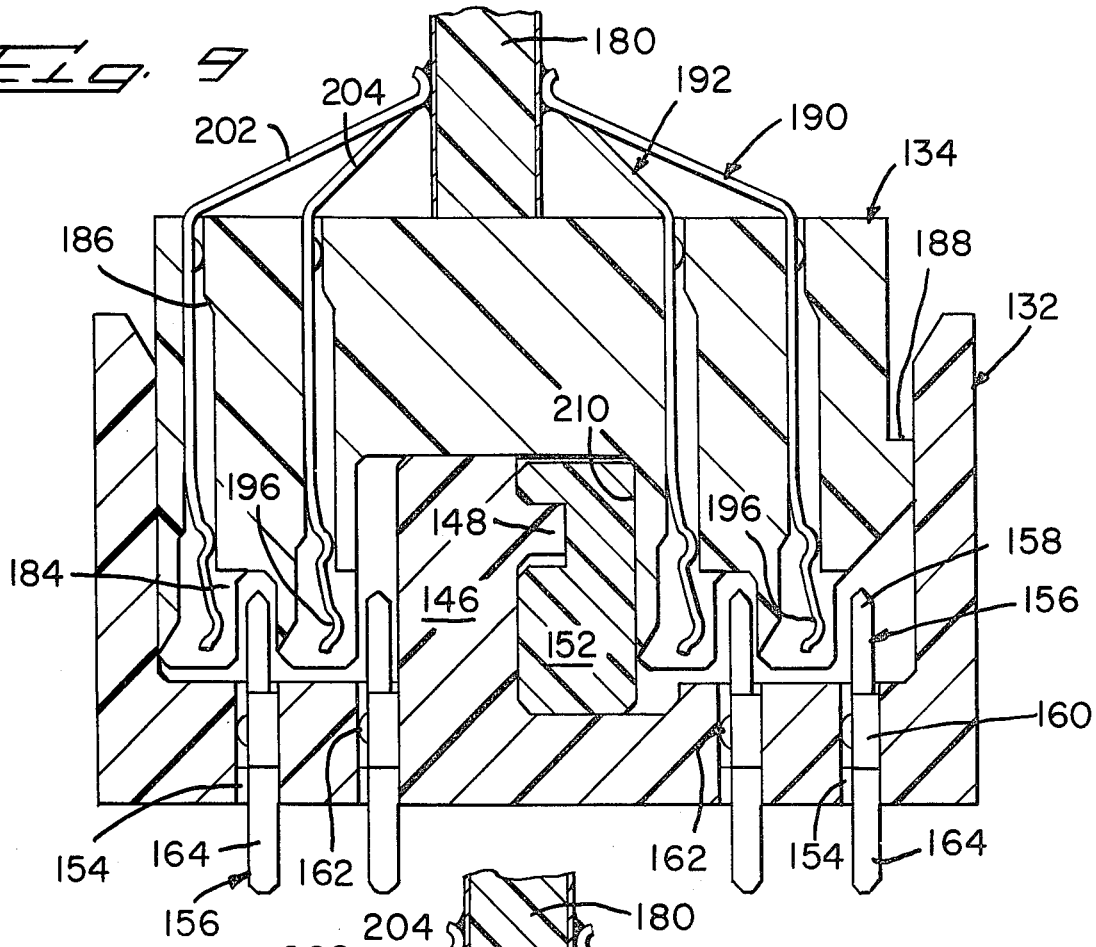
FIGS. 9 and 10 are end cross-sectional views showing the two members of FIG. 7 in a mated open and closed position respectively.

With reference to FIGS. 7 and 9, groove 144 in floor 140 and support wall 146 occupy the longitudinal center of lower member 132. A series of spaced passages 154 extend vertically through floor 140. There are four parallel lines of passages extending from front to back of the lower member with two lines on each side of groove 144/support wall 146. The passages are in alignment transversely as well as longitudinally.

Figure 12:
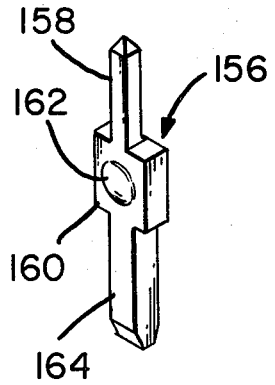

Each passage contains a first contact element 156. FIG. 12 shows an element 156 in perspective. A square post provides contact surface 158. Intermediate section 160 contains thereon embossment 162. A rectangular post 164, attached to the base of section 160, is adapted for insertion into a printed circuit board such as shown in FIGS. 2–4. These contact elements are positioned in passages 154 with contact surface 158 extending above floor 140 and post 164 depending from lower member 132. The intermediate section is lodged in the passage with embossment 162 acting to retain the element in place. FIG. 9 illustrates the elements in the passages clearly.

In addition to bar 152, cam means 142 includes a front piece 166 which is positioned at right angles to the bar. Further, it slides along floor 140 by reason of its lower surface being vertically displaced upwardly relative to bar 152.

A number of square openings 168 are provided along sidewall 136 to receive locking fingers on upper member 134.

With regard to upper member 134, FIGS. 7 and 8 shows it to be an elongated rectangular body 170 with four ribs 172 depending from its underside. The ribs extend the length of the body and are arranged so that two ribs are adjacent each side with a sizeable space 174 therebetween.

Upper surface 176 of body 170 has thereon suitable devices, such as indicated by reference numeral 178, to retain circuit card 180.

Passages 182 extend vertically through body 170 and ribs 172. As shown in FIG. 9, the passages in ribs 172 are open to one side, these lateral openings being indicated by reference numeral 184 in FIG. 9. Further, each passage is expanded in one dimension as indicated by downwardly facing beveled surface 186.

Passages 182 are located in four longitudinal lines with two lines being adjacent the sides of body 170; i.e., corresponding to ribs 172. The passages are aligned transversely. Several spaced apart fingers 188 project outwardly from the right side of body 170.

Upper member 134 carries a number of second and third contact elements 190 and 192 respectively. Elements 190 are located in the outer passages; i.e., the immediately adjacent the sides of body 170 and elements 192 are in the inside passages. FIG. 9 shows this positioning.

Figure 11:
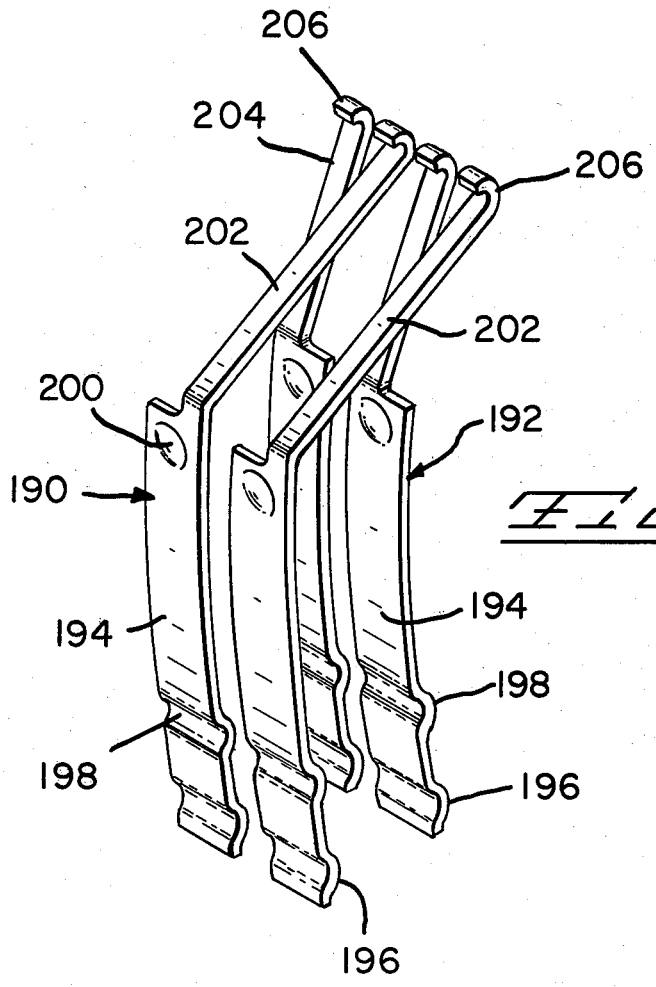
FIGS. 11 and 12 illustrate contact elements carried in the two members of FIGS. 7–10.

FIG. 11 is a perspective view of the aforementioned contact elements. Both elements 190 and 192 have identical intermediate sections 194 and convex lower contact surfaces 196. The lower end of the intermediate sections include a convex bearing surface 198. Further, an embossment 200 is provided on the intermediate sections to retain the elements in the passages.

Elements 190 have an elongated beam 202 extending obliquely upwardly from one side of intermediate section 194. Elements 194 have a relatively shorter beam 204 extending upwardly at a slighter angle and from an opposite side of its intermediate section. The free ends of both beams are reversely bent to provide a convex upper contact surface 206.

With reference to FIG. 9, upon comparing the contact elements on each side of card 180, it is apparent that beams 202–204 on the right side are bent oppositely (relative to the intermediate section) to the direction of bend on the left side. The lower contact surfaces 196 on all elements are facing in the same direction, however; i.e., towards lateral openings 184.

Further, as is clearly shown in FIG. 9, the lower ends of elements 190–192, including bearing surfaces 198 and lower contact surfaces 196, are bent to the right so that they are preloaded when positioned in the passages.

With contact element 190 in an outer passage and contact element 192 in an inner passage immediately in front of the outer passage, the upper contact surfaces 206 of both elements are in a side-by-side relation and contact parallel conductive traces 208 (FIG. 1) on card 180 at the same height above the surface of the upper member. These contact surfaces are shown as being soldered to the traces. However, the beams may be preloaded so that they bear against the traces with sufficient force to make and maintain good electrical contact.

Figure 10:
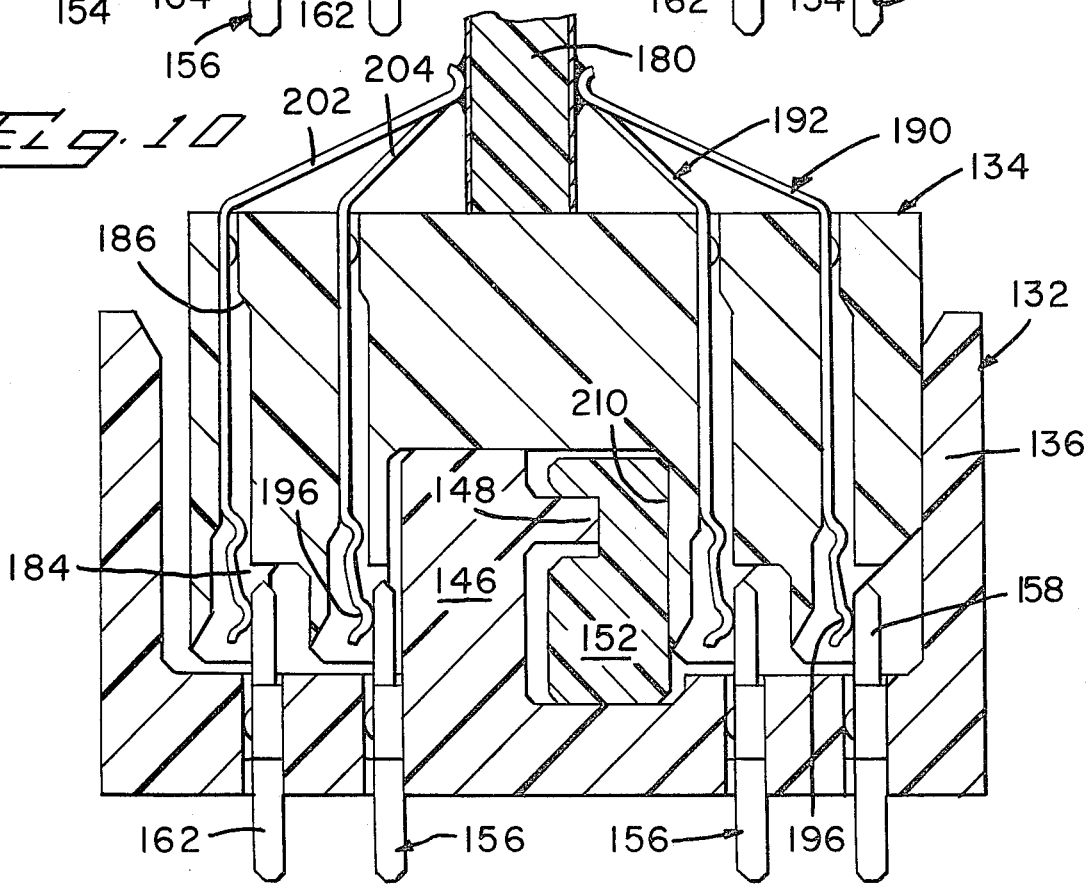

FIG. 7 shows the two members exploded away from each other. FIGS. 8 and 10 show the two members mated and in a closed position; i.e., contact surfaces 196 are pressed against contact surfaces 158.

FIG. 9 shows the upper and lower members in mated but open position; i.e., elements 156 are not in contact with elements 190–192. The upper member 134 is received in lower member 132 such that bar 152 on cam means 142 and support wall 146 protrude into space 174 (FIG. 7). The inside surface, designated by reference numeral 210 in FIGS. 7 and 9, of the rib 172 adjacent space 174 bears against bar 152.

By moving cam means 142 forwardly, the bosses and ramps (FIG. 5) cooperate to move the cam means laterally towards side wall 136. Lower contact surfaces 196 engage contact surfaces 158 to establish electrical contact through the contact elements in the known manner. Fingers 188 on upper member 134 enter openings 168 to removably lock the two members together.

Although not shown, lower member 132 would be mounted on a printed circuit board as shown for the lower member 10.

We claim:

1. A connector system for electrically connecting a circuit card to a circuit board, comprising:

a. an elongated lower member made from insulating material and having a plurality of spaced apart passages extending vertically therethrough, said passages being arranged in a line running lengthwise of the lower member;

b. a plurality of conductive contact elements positioned in the passages with the elements having an upper contact surface extending above the top surface of the lower member and a lower end extending below said member for insertion into a printed circuit board for making electrical contact with conductive traces thereon;

c. an elongated upper member made from insulating material and having an elongated rib depending from and extending lengthwise of the underside thereof with the rib having a plurality of spaced apart lateral openings along one side, further said member having a plurality of passages extending vertically therethrough and into the rib intersecting the lateral openings therein, said upper member further having means on the upper surface thereof for securing a circuit card thereto with the card being on an edge and parallel to the passages, said upper member being received onto the top surface of the lower member with the lateral openings being in registration with the upper contact surfaces;

d. a plurality of conductive contact elements positioned in the passages in the upper member and having card engaging contact surfaces extending above the top surface thereof for engaging conductive traces on a card which may be positioned thereon and further having lower contact surfaces positioned in the lateral openings in the rib;

e. camming means mounted on the lower member for moving the upper member laterally on the top surface of the lower member whereupon the upper contact surfaces are received in the lateral openings to engage and electrically contact the lower contact surfaces positioned therein.

2. The connector system of claim 1 wherein the upper member has two or more parallel, depending ribs with corresponding lines of passages and contact elements positioned therein, said passages being aligned to form rows crossing the width of the upper member and the lower member having two or more parallel line passages with contact elements therein and being arranged to conformably mesh with the corresponding ribs and contact elements on the upper member when the two members are mated together.

* * * * *